US005274889A

United States Patent [19]

Morita

[11] Patent Number: 5,274,889

[45] Date of Patent: Jan. 4, 1994

[54] FASTENER MEANS

[75] Inventor: Tamao Morita, Tokyo, Japan

[73] Assignee: Tarmo Co., Ltd., Tokyo, Japan

[21] Appl. No.: 937,762

[22] Filed: Sep. 1, 1992

Related U.S. Application Data

[63] Continuation of Ser. No. 790,990, Nov. 13, 1991, Pat. No. 5,142,746.

[30] Foreign Application Priority Data

Dec. 11, 1990 [JP] Japan ..... 2-409967

[51] Int. Cl.[5] ..... A44B 21/00; H01F 7/00

[52] U.S. Cl. ..... 24/303; 292/251.5; 335/285

[58] Field of Search ..... 24/303; 688, 94, 49M; 335/285; 292/251.5; 63/29.2

[56] References Cited

U.S. PATENT DOCUMENTS

| | | | |
|---|---|---|---|
| 4,453,294 | 6/1984 | Morita | 24/303 |
| 4,455,719 | 6/1984 | Morita | 24/303 |
| 4,480,361 | 11/1984 | Morita | 24/303 |
| 4,700,436 | 10/1987 | Morita | 24/303 |
| 4,779,314 | 10/1988 | Aoki | 24/303 |
| 4,991,270 | 2/1991 | Aoki | 24/303 |
| 5,042,116 | 8/1991 | Ossiani | 24/303 |

FOREIGN PATENT DOCUMENTS

| | | | |
|---|---|---|---|
| 0105511 | 6/1983 | Japan | 335/285 |
| 0170008 | 10/1983 | Japan | 335/285 |
| 0216307 | 9/1986 | Japan | 335/285 |
| 0179505 | 7/1988 | Japan | 335/285 |

*Primary Examiner*—Victor N. Sakran

*Attorney, Agent, or Firm*—Pennie & Edmonds

[57] ABSTRACT

The present invention relates to a fastener means which utilizes the attraction force of a permanent magnet and which is characterized in that a ferromagnetic member attached to one of the magnetic pole surfaces of an annular permanent magnet constituting the fastener means and having a through-hole extending between the magnetic poles and a ferromagnetic member attached to the other magnetic pole are detachably attracted to each other via said through-hole, and portions of the surfaces of the permanent magnet to which the first ferromagnetic member is not contacting the permanent magnet, excluding the peripheral surface of the through-hole or including the peripheral surface at the mouth of the through-hole, are covered with a ferromagnetic casing or a ferromagnetic material, such as a ferromagnetically plated sheet, having the thickness of about 0.03 to 0.20 mm.

12 Claims, 8 Drawing Sheets

FASTENER MEANS

This is a continuation of application Ser. No. 07/790,990, filed Nov. 13, 1991, now U.S. Pat. No. 5,142,746.

SUMMARY OF THE INVENTION

The present invention relates to a fastener means which utilizes the attraction force of a permanent magnet. More particularly, it relates to a fastener means in which leakage flux of the permanent magnet is significantly reduced without decreasing the attraction force of the fastener means.

Still more particularly, the fastener means according to the present invention comprises an annular permanent magnet having a through-hole extending between the magnetic poles, a first ferromagnetic member attached on one of the magnetic pole surfaces of the permanent magnet, and a second ferromagnetic member attached to the other magnetic pole surface, and is characterized in that the ferromagnetic members are detachably attracted to each other via said through-hole, and portions of the surfaces of the permanent magnet to which the first ferromagnetic member is not contacting the permanent magnet, excluding the peripheral surface of the through-hole or including the peripheral surface at the mouth of the through-hole, are covered with a ferromagnetic casing or a ferromagnetic material, such as a ferromagnetically plated sheet, having the thickness of about 0.03 to 0.20 mm.

DETAILED DESCRIPTION OF THE INVENTION

Background of the Invention

Figure 1:
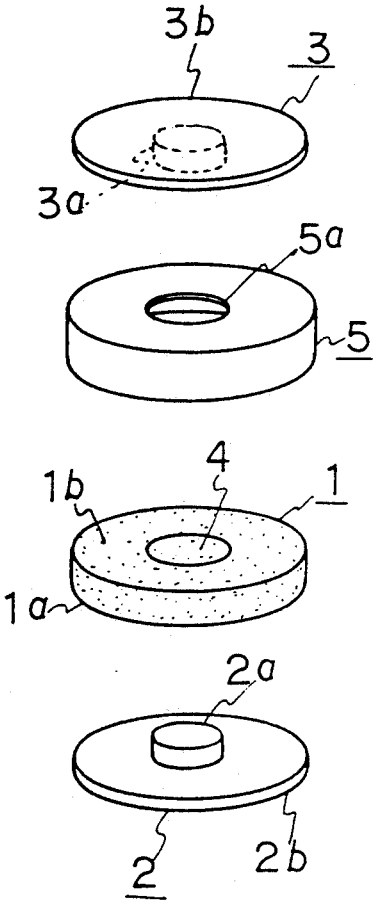

Fastener means utilizing the attraction force of a permanent magnet come in various constructions, and are widely used for luggages, bags, containers, and furniture. Typically, such a fastener means comprises an attraction means which is made of a ferromagnetic material and attached to one of the magnetic poles of an annular permanent magnet, and a means to be attracted which is made of a ferromagnetic material, detachably attracted to the other pole of the attraction means and abutted against and attracted to the other ferromagnetic material via the center through-hole of the attraction means.

The permanent magnet constituting the attraction means of the fastener is usually a sintered magnet such as a ferrite magnet. This significantly impairs the appearance of the fastener, and cannot be used as it is without covering the magnet with a casing, or coating or plating its surface.

Need for an outer case or coating/plating to protect the permanent magnet is also felt as the magnet is susceptible to impacts and can easily become broken or cracked.

In the prior art, attempts were made to retain and fix the permanent magnet together with the ferromagnetic member by using a non-magnetic case such as made of brass, to thereby form an attraction means. To effectively utilize the attraction force of the permanent magnet, the attraction means of a fastener means of this type is provided with a through-hole which extends between the two magnetic poles of the magnet and a ferromagnetic member attached to one of the magnetic poles, so that the means to be attracted can be attracted to the other pole of the attraction means.

When the permanent magnet and the ferromagnetic member attached thereto are covered with a casing made of a ferromagnetic material such as iron, the magnetic poles of the permanent magnet constituting the attraction means are magnetically connected via the ferromagnetic case. The magnetic flux passing through the contact surface of the ferromagnetic members that are contacted and attracted to each other via the center through-hole of the attraction means decreases for the amount that leaks into the ferromagnetic case extending between the two magnetic poles, resulting in a substantial decrease of the attraction force of the attraction means.

It has therefore been a general practice to use a non-magnetic casing as the means to retain the permanent magnet in place. The permanent magnet and the ferromagnetic member to be attached to one of the magnetic poles of the permanent magnet are housed inside the casing to provide the attraction means.

In the construction where the permanent magnet is covered with a non-magnetic casing to form the attraction means, the magnetic flux of the permanent magnet passes through the contact surface of the ferromagnetic members that are contacted and attracted to each other via the center through-hole of the magnet, and is fully utilized. This construction is also advantageous in that the permanent magnet and the ferromagnetic member to be attached thereto are integrally held, and the appearance of the permanent magnet can be efficiently dressed presentable.

However, non-magnetic cases of this type are usually made of a soft material, and when a thin non-magnetic case is used in particular, the roughened surface of the permanent magnet which is housed inside often shows on the surface of the case as the case is compressed, necessitating use of a thick case.

When a thick non-magnetic case is used, on the other hand, the ferromagnetic member constituting the attracted means has to be attracted to the magnetic pole of the permanent magnet via this thick non-magnetic case, resulting in a significant decrease in the attraction force of the permanent magnet.

Leakage flux at the surface of the attraction means when it is covered with a non-magnetic case often exceeds 300 gauss. This leakage flux disadvantageously causes destruction of magnetically recorded information on various means such as magnetic tickets, cards, tapes and disks.

OBJECT OF THE INVENTION

An object of the present invention is mainly to improve the prior art fastener means that utilizes the attraction force of a permanent magnet. The present invention aims at providing a fastener means wherein the leakage flux from the surface of the attraction means is minimized without decreasing the attraction force of the fastener means.

A main object of the fastener means according to the present invention is to prevent intense leakage flux from occurring on the surface of the attraction means. In other words, it aims to prevent troubles from being caused by intense leakage flux on the surface of the attraction means. For example, information magnetically recorded on cash cards and credit cards can be protected against destruction even when placed in the proximity of the attraction means of the fastener means.

Magnetically operable subway tickets can also be protected against such destruction. Further, magnetically recorded information on tapes and disks can be protected against destruction even when the tapes and disks are placed near the fastener means. Still further, magnetically recorded information on other such means can be protected against destruction even when they are placed near the fastener means.

Another object of the invention is to prevent formation of a magnetic gap at the portion where the attraction means and the attracted means contact each other. In other words, as the permanent magnet constituting the attraction means and the attracted means to be attracted to one of the magnetic poles of the permanent magnet are contacted via a ferromagnetic member, there is no possibility for a magnetic gap to be formed therebetween, assuring efficient attraction force to be working between the attraction means and the attracted means.

Further objects of the invention will become apparent from the detailed description below and the scope of the patent claim.

Figure 3:
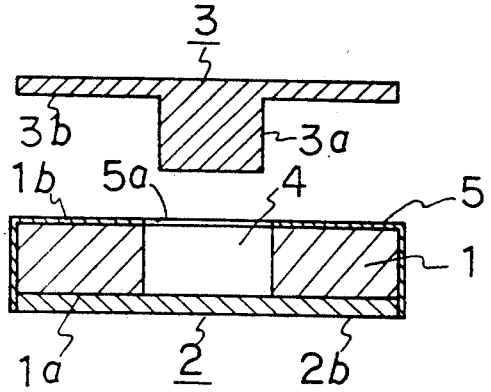
Figure 2:
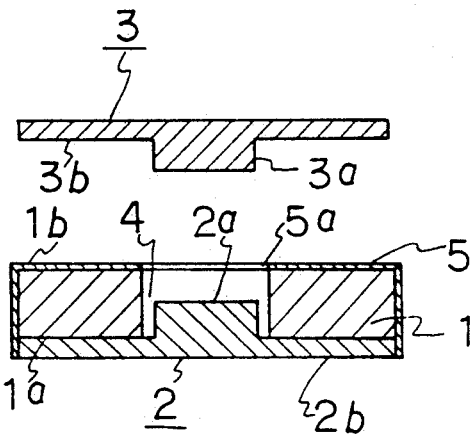
Figure 4:
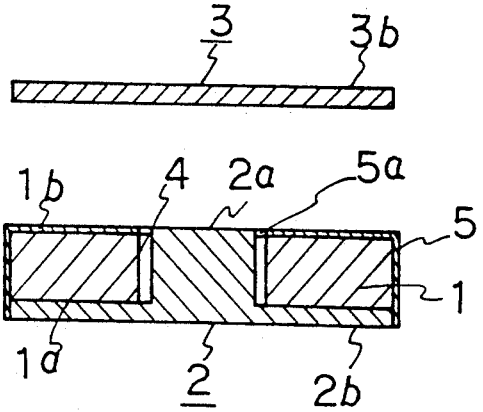
Figure 5:
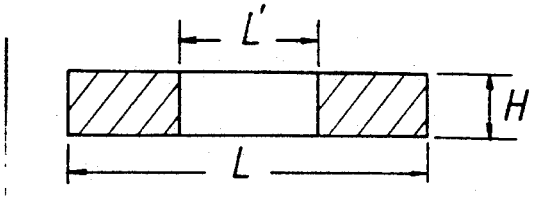
Figure 6:
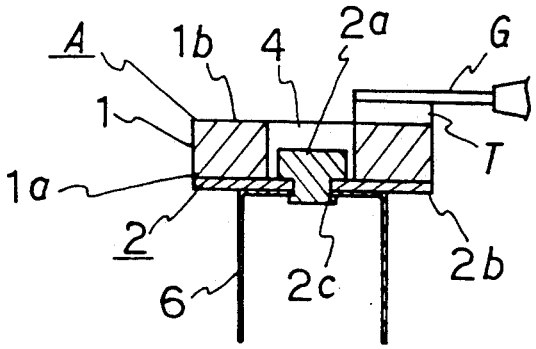
Figure 7:
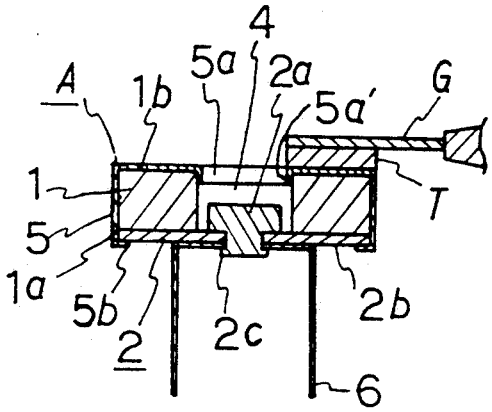
Figure 8:
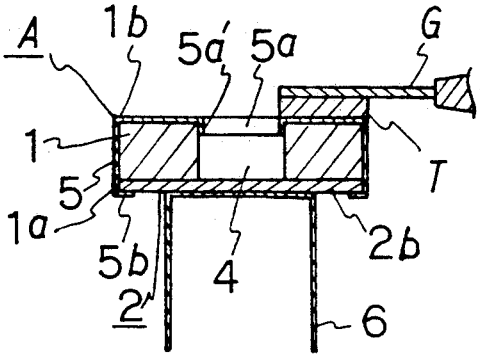
Figure 9:
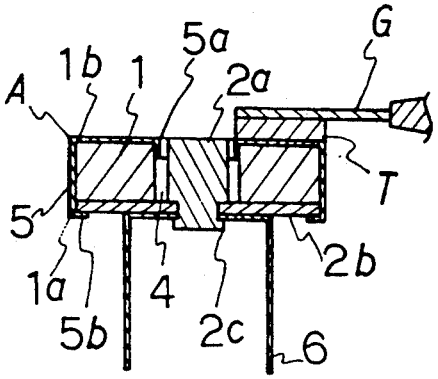
Figure 10:
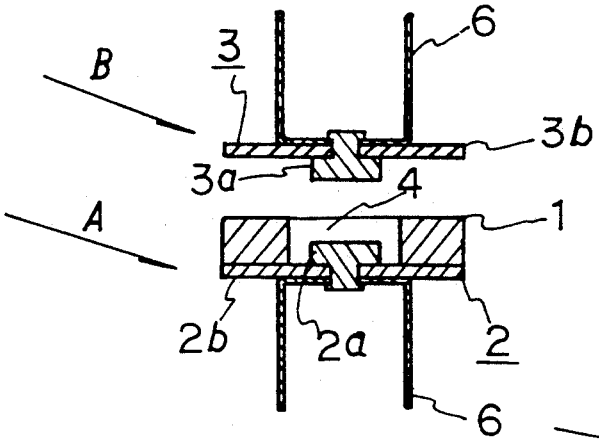
Figure 12:
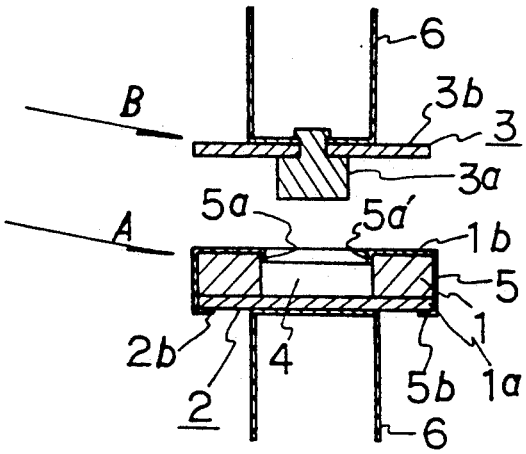
Figure 11:
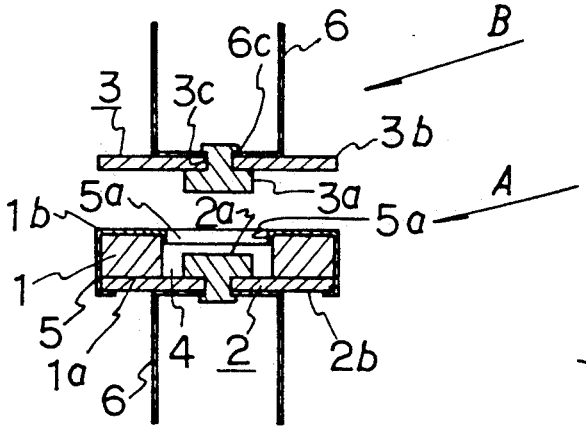
Figure 13:
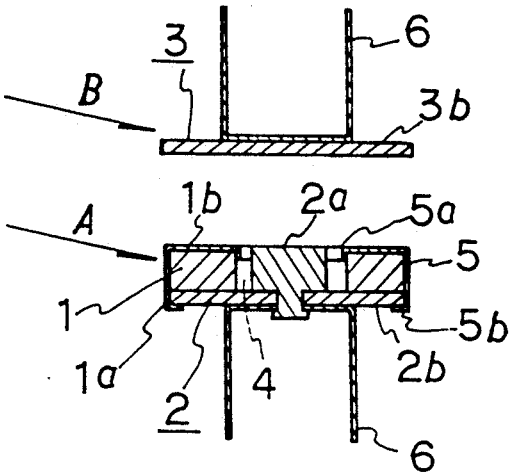
Figure 14:
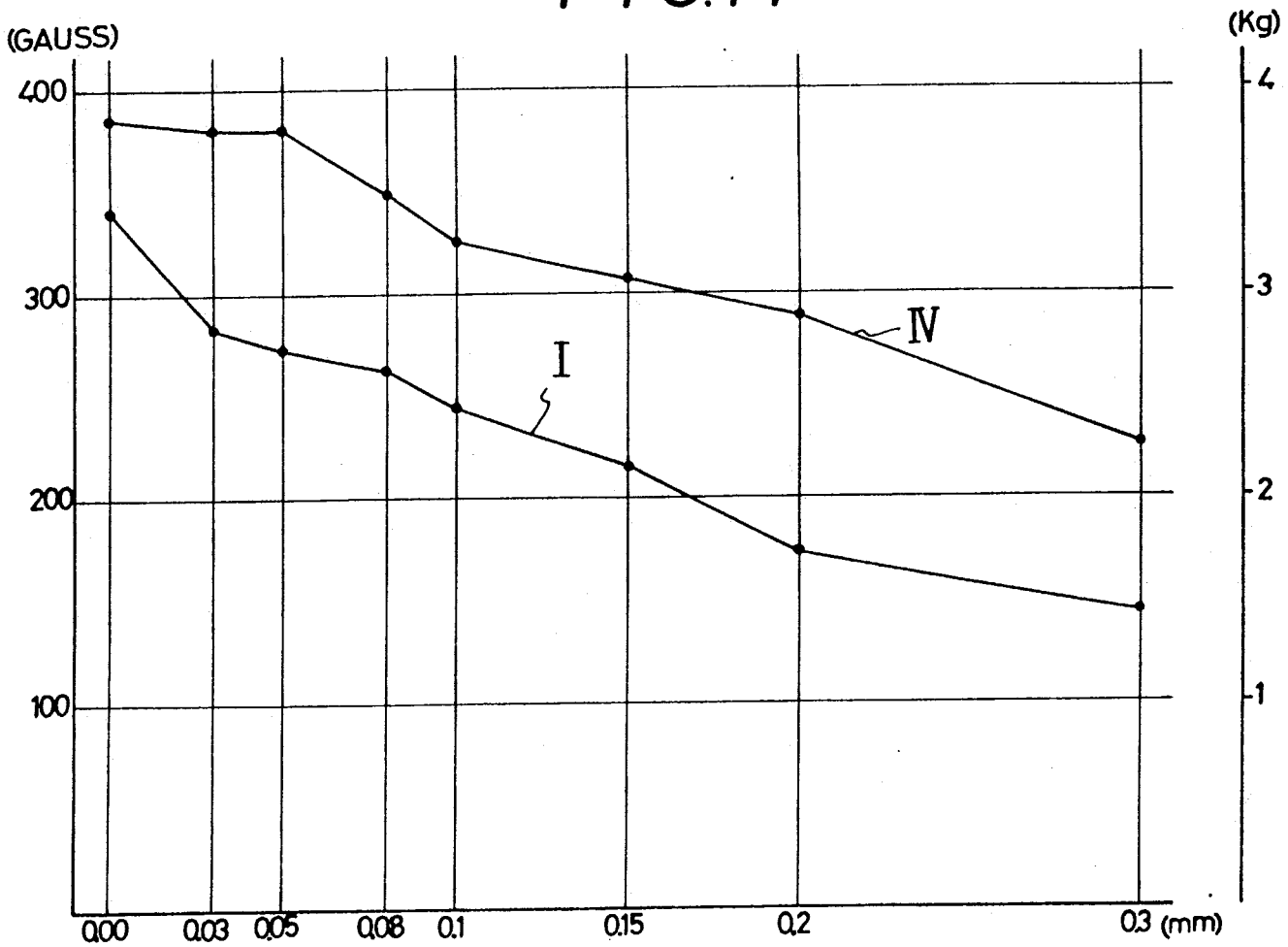
Figure 15:
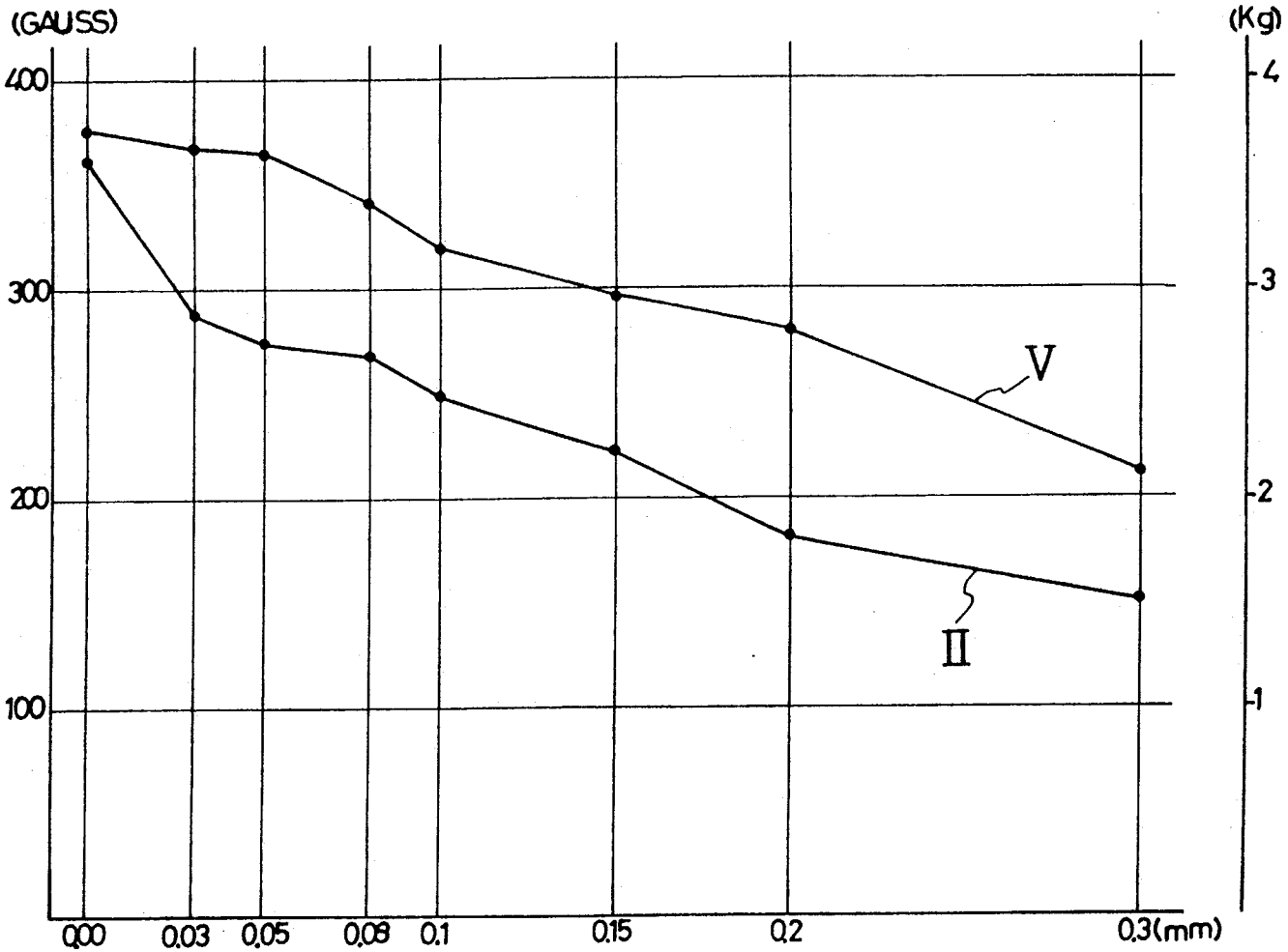
Figure 16:
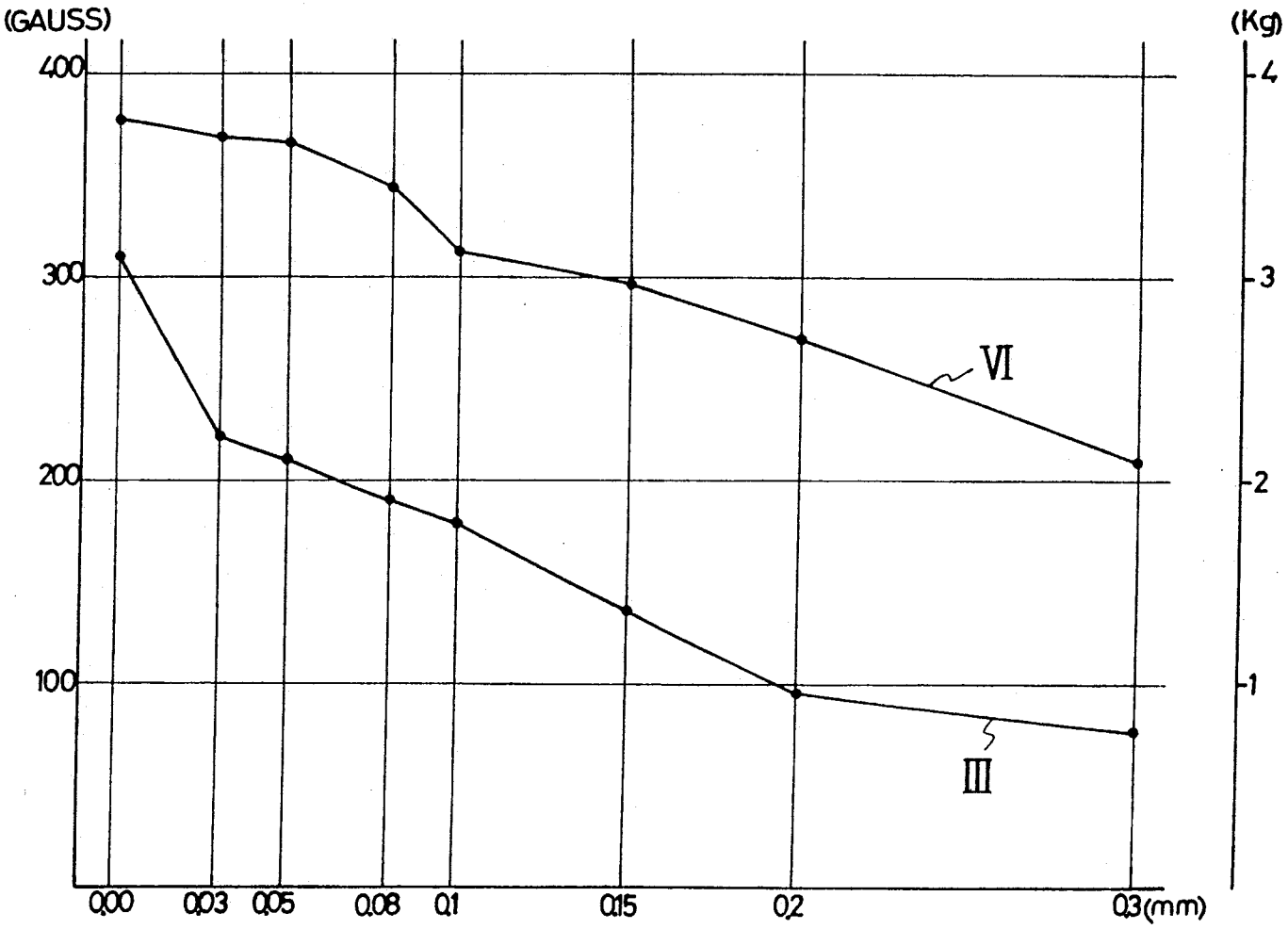
Figure 17:
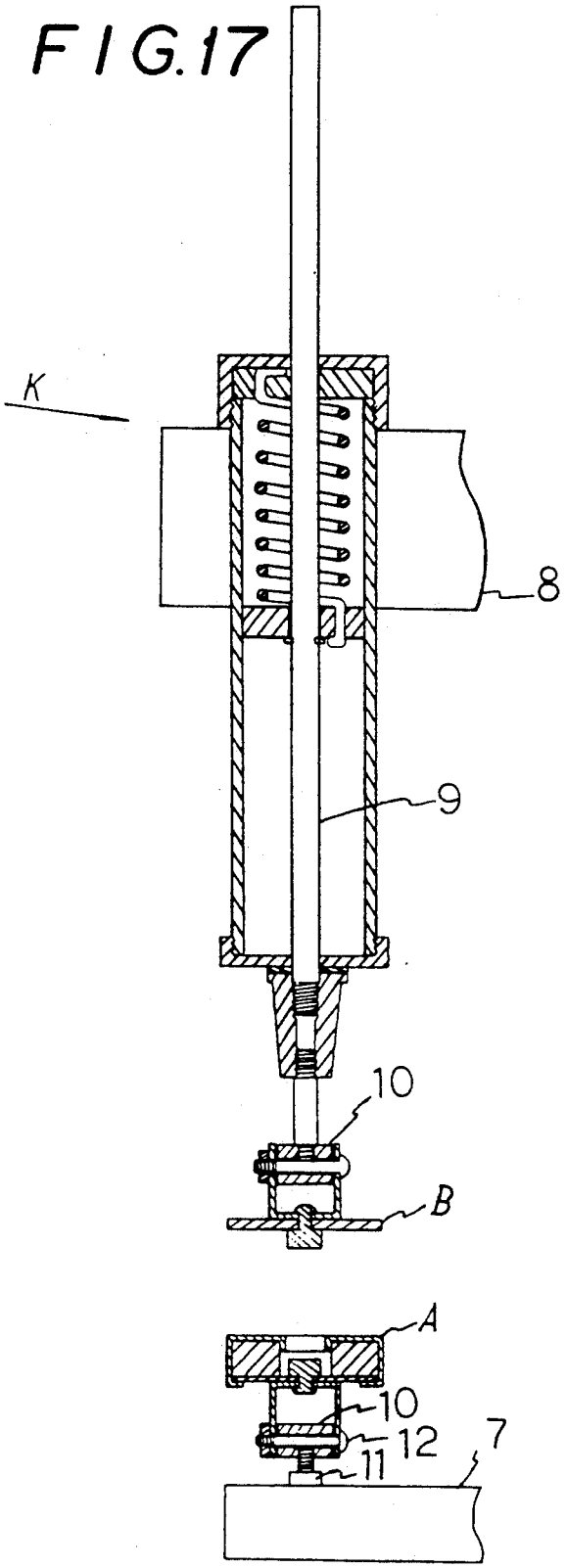
Figure 18:
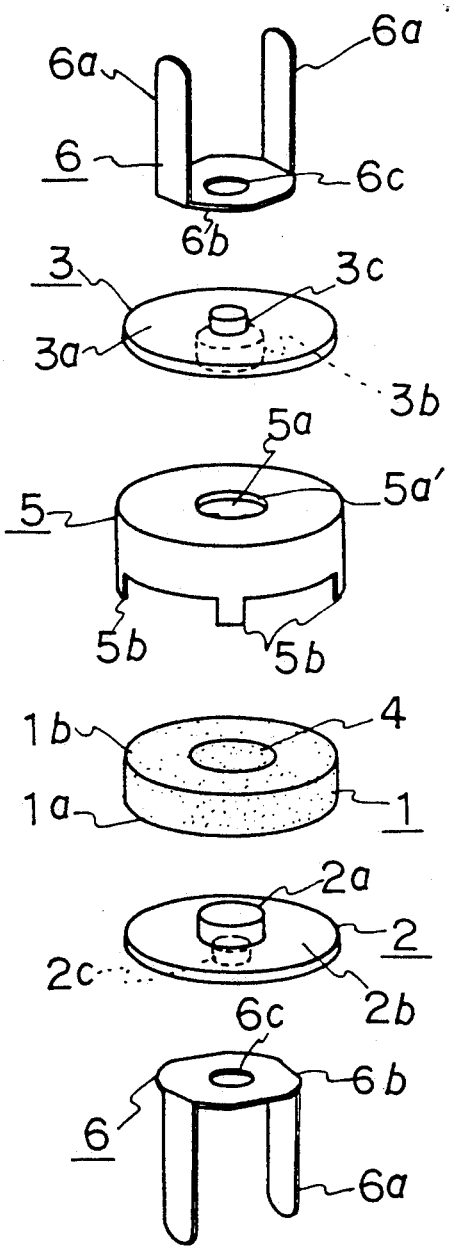
Figure 19:
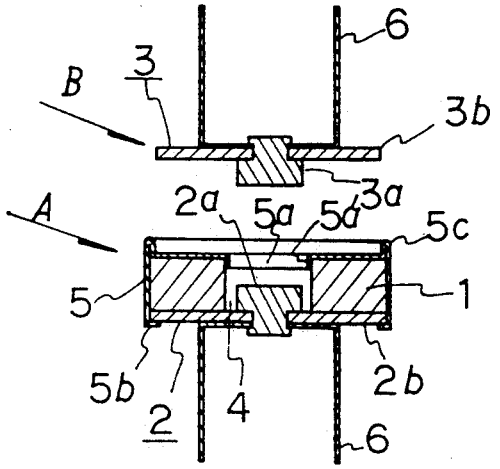
Figure 20:
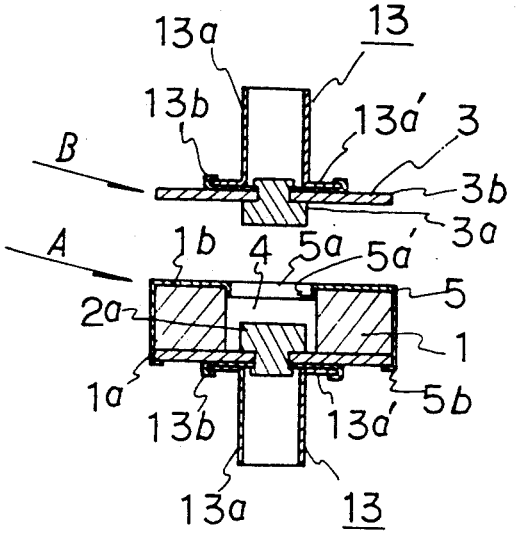
Figure 21:
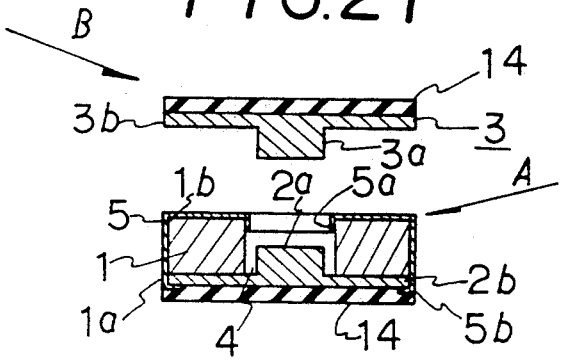
Figure 22:
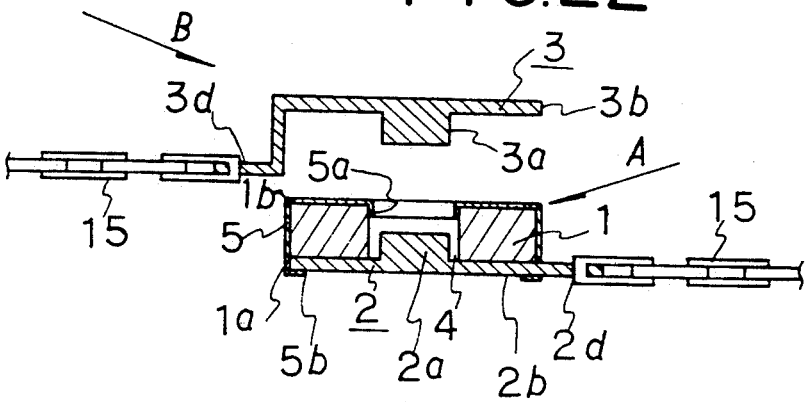

FIGS. 1 through 3 show embodiments of a fastener means according to this invention. FIG. 1 is a perspective view to show a fastener means as exploded into component parts. FIG. 2 is a sectional view thereof. FIG. 3 shows another embodiment in section. FIG. 4 shows still another embodiment in section. FIG. 5 is a sectional view to show the permanent magnet used in the measurement. FIG. 6 is a sectional view to show the method of measuring the gauss of the attraction means. FIG. 7 is a sectional view to show another method of measuring the gauss of the attraction means. FIG. 8 is a sectional view to show still another method of measuring the gauss of the attraction means. FIG. 9 is a sectional view to show still another method of measuring the gauss of the attraction means. FIG. 10 is a sectional view to show the fastener means used to measure the attraction force. FIG. 11 is a sectional view to show another fastener means used to measure the attraction force. FIG. 12 is a sectional view to show still another fastener means used in the measurement of the attraction force. FIG. 13 is a sectional view to show still another fastener means used in the measurement of the attraction force. FIG. 14 is a graph to show the attraction force and the leakage flux of the fastener means. FIG. 15 is a graph to show the attraction force and the leakage flux of another fastener means. FIG. 16 is a graph to show the attraction force and the leakage flux of still another fastener means. FIG. 17 is a sectional view to show the essential part of the device for measuring the attraction force of the fastener means. FIG. 18 is an exploded perspective view to show a typical embodiment of the fastener means. FIG. 19 is a sectional view to show still another embodiment of fastener means. FIG. 20 is a sectional view to show still another embodiment of fastener means. FIG. 21 is a sectional view to show still another embodiment of fastener means. FIG. 22 is a sectional view to show still another embodiment of fastener means.

EMBODIMENTS

Embodiments according to this invention will now be described in detail. The fastener means shown in FIGS. 1 through 4 is a typical first embodiment wherein the ferromagnetic member 5 covering the permanent magnet 1 is formed as a casing that envelopes the surfaces of the permanent magnet 1 to which the ferromagnetic member 2 is not attached, excluding the peripheral surface of the through-hole 4. The fastener means shown in FIGS. 7 through 9, FIGS. 11 through 13 and FIGS. 18 through 22 is a typical second embodiment wherein the casing of the ferromagnetic member 5 covering the permanent magnet 1 also covers the peripheral surface of the through-hole 4 at its mouth on the permanent magnet. FIG. 1 is an exploded view to show the component parts of a fastener means according to a typical embodiment of the invention; FIG. 2 shows the same in section; and FIGS. 3 and 4 are sectional views to show modified embodiments respectively.

The fastener means shown in FIGS. 1 through 4 will now be described. The fastener means shown in FIGS. 1 and 2 comprises an annular permanent magnet 1 having a through-hole 4 extending between the magnetic poles, a plate-like ferromagnetic member 2 which is to be abutted against one of the magnetic pole surfaces 1*a* of the permanent magnet 1 and is integrally held together therewith by a casing 5 made of a ferromagnetic material, and a plate-like ferromagnetic member 3 which is to be attracted to the other magnetic pole surface 1*b* via said ferromagnetic member 5. There are provided a projection 2*a* on the ferromagnetic member 2 which extends into said through-hole 4 of the permanent magnet 1, and a projection 3*a* on the ferromagnetic member 3 which will contact said projection 2*a*. The construction is such that when the plate member 3*b* of the ferromagnetic member 3 attracted to the permanent magnet 1 is in contact with the surface of said ferromagnetic member 5, the projection 3*a* of said ferromagnetic member 3 comes in contact with the projection 2*a* of the member 2.

The ferromagnetic member 5 is made of a material that will be attracted to the permanent magnet such as iron, cobalt, nickel and alloys thereof, and is shaped like a dish placed upside down. There is a hole 5*a* made at the bottom of the inverted dish which communicates with the through-hole 4*a* of the magnet 1. The permanent magnet 1 is housed inside the casing made of this ferromagnetic member 5. The ferromagnetic member 2 is also housed inside the casing made of the ferromagnetic member 5 in such a way that the projection 2*a* projects into the through-hole 4 of the magnet 1. The ferromagnetic casing 5 integrally retains the component parts together. It is noted that the ferromagnetic member 5 is intended to cover the surfaces of the permanent magnet 1 to which the ferromagnetic member 2 is not contacting the permanent magnet. Therefore, the ferromagnetic member 5 may be extended to cover at least the peripheral edge of the ferromagnetic member 2 as well, as shown in FIGS. 2–4.

Ferromagnetic material for the member 5 includes any material which is attracted to a permanent magnet such as iron, cobalt, nickel and alloys thereof. Therefore, those stainless steel materials that are attracted to a permanent magnet are also included. The ferromagnetic member 5 is designed to have the thickness in the range of from 0.03 to 0.20 mm in view of the magnitude of leakage flux to be described hereinafter as relative to the attraction force of the fastener means.

The fastener means shown in FIG. 3 will now be described. In this embodiment, the ferromagnetic member 2 has no projection 2*a* but comprises a plate member 2*b* alone. The projection 3*a* of the ferromagnetic member 3 to be attracted to the magnet 1 fits into the through-hole 4 of the magnet 1 and is attracted to the plate member 2*b* of the ferromagnetic member 2.

The fastener means shown in FIG. 4 will now be described. In this embodiment, the projection 2a of the ferromagnetic member 2 protrudes slightly outside the through-hole 4 of the magnet 1, or is flush with or slightly below the open edge of the through-hole 4. The top surface of the projection 2a directly contacts the ferromagnetic member 3. Preferably, a ridge which abuts the peripheral side face of the magnet 1 is provided along the peripheral edge of the ferromagnetic member 3 to prevent the ferromagnetic member 3 from laterally sliding on the contact face with the magnet 1 when the member 3 is attracted to the magnet 1.

The term "ferromagnetic member 5" used herein means a member which is made of a material that can be attracted to a permanent magnet, as mentioned with respect to the embodiment shown in FIGS. 1 and 2, and has the thickness in the range of from 0.03 to 0.20 mm. Although the ferromagnetic member 5 is shown as an inverted dish in the embodiment, it may be a plated ferromagnetic film. The ferromagnetic member may be covered with non-ferromagnetic plating so long as the ferromagnetic member has the thickness of from 0.03 to 0.20 mm.

Leakage of magnetism from and the attraction force of the fastener means can be controlled in the manner to be described below as the surfaces of the magnet 1, particularly the surfaces other than the magnetic pole surface 1a where the ferromagnetic member 2 is attached are covered with the ferromagnetic member 5 having the thickness of from 0.03 to 0.20 mm.

The permanent magnet 1 used in the embodiment is an annular magnet shaped like a doughnut, as shown in FIG. 5 and measures 17.5 mm in diameter L, 3 mm in thickness H, and 7.5 mm in hole diameter L'.

FIGS. 6 through 9 show the embodiment of attraction means A which is one of the component parts of the fastener means subjected to measurement. A non-magnetic material T is attached to the top face of the attraction means A, to which the sensor G of a gauss meter is contacted for measurement. The attraction means used A herein comprises the permanent magnet 1 shown in FIG. 5, a ferromagnetic member 2 having the thickness of 1 mm with a plate member 2b, a ferromagnetic projection 2a of 6 mm diameter and 1.67 mm height, and a bent leg member 6, the projection and the leg member being integrally caulked together. The counterpart members in Comparative Embodiment shown in FIG. 6 are integrally held together by means of adhesive, and those in the Embodiment shown in FIG. 7 are integrally held together by means of a ferromagnetic casing 5.

The ferromagnetic member 2 shown in FIG. 8 comprises the plate member 2b alone and has no projection 2a and is integrally held together with the permanent magnet by means of the ferromagnetic member 5, to form the attraction means A. In the embodiment shown in FIG. 9, the projection 2a extends in the through-hole 4 of the magnet 1 and its top is substantially flush with the attraction surface of the attraction means A. Similarly as mentioned above, the ferromagnetic member 5 retains the permanent magnet 1 integrally with the ferromagnetic member 2 and other parts to form the attraction means A to be subjected to measurement.

The leg member 6 comprises a seat 6b having a hole 6c through which the portion of the projection 2a with a smaller diameter passes, and two opposing leg strips 6a, 6a at both ends of the seat 6b. In the attraction means A shown in FIGS. 6, 7 and 9, the portion of the projection 2a with a smaller diameter is fitted in the hole 2c in the ferromagnetic member 2 and caulked with the plate member 2b.

In the attraction means A shown in FIG. 8, the seat 6b of the leg member 6 is not provided with the hole 6c; instead, the leg member 6 is welded to the plate member 2b of the ferromagnetic member 2.

A gauss meter of galvanomagnetic effect type with a gallium arsenide sensor is used for measurement. (Model GT-3B by Nippon Denji Sokutei Kiki K.K.)

Standard steel SK-2 used in JIS measurements is used as the ferromagnetic member 5 for the attraction means A.

In the following measurements, the Embodiments used are those provided at the back of the permanent magnet with a ferromagnetic member 5 having a thickness ranging from 0.03 to 0.20 mm. A fastener means in which the permanent magnet is not provided at its back with a ferromagnetic member 5, and the one provided with a ferromagnetic member 5 which is 0.30 mm in thickness are used as the Comparative Embodiments.

Attraction force of the fastener means was measured using the attracted means shown in FIGS. 10 through 13 attracted to the attraction means shown in FIGS. 6 through 9 respectively.

The attracted means B according to the Embodiments and Comparative Embodiments shown respectively in FIGS. 10 through 13 each comprise a ferromagnetic member 3 and a leg member 6 such as shown in FIGS. 6 through 9 respectively. In the attracted means B shown in FIGS. 10 through 12, the portion of the projection 3b with a smaller diameter is fitted in the hole 3c of the plate member 3b and through the hole 6c of the leg member 6 and integrally caulked with the leg member 6. The projection 3a is so formed that when it comes in contact with the projection 2a or the plate member 2b of the ferromagnetic member 2 within the through-hole 4 of the magnet 1, the plate member 3b of the ferromagnetic member 3 comes in contact with the attraction face of the attraction means A.

The attracted means B of the Embodiment shown in FIG. 13 has no projection 3b; instead, the plate member 3b thereof is directly contacted with the attraction face and the projection 2a of the attraction means A. The seat 6b of the leg member 6 is welded to the plate member 3b. The plate member 3b of the ferromagnetic member 3 in the attracted means B has a thickness of 1.0 mm, and the projection 3a has a diameter of 6 mm.

FIG. 17 shows the device used to measure the attraction force of the fastener means. The attraction means A is attached to a table 7 of an instrument K. The attracted means B is attached to the tip end of a tension rod 9 which in turn is attached to a movable arm 8 of the instrument K. The movable arm 8 is pulled up, and the pulling force (kg) which pulls the attraction means A and the attracted means B apart is measured. (A cylindrical standard tension gage by Oba Keiki Seisakusho was used. A sleeve 10 each was interposed between the leg strips 6a, 6a of the leg member 6 both in the attraction means A and attracted means B. The tip of a fixing screw 11 was screwed to the sleeve, and a hole each was made in the leg strips 6a, 6a. A pin 12 was inserted in each of the holes to reach the sleeve 10 to attach the means A and B respectively to the device.)

Amount of magnetic flux in the attraction means A both according to the Embodiments and Comparative Embodiments was measured.

First, leakage flux from the attraction surface of the attraction means A of the Embodiments as shown in FIG. 7 and of the Comparative Embodiments was measured. The sensor G of the gauss meter was disposed 2.5 mm away from and parallel to the attraction surface by interposing a non-magnetic material T having the thickness of 2.5 mm and the leakage flux from the attraction surface was measured at this distance. (Magnetic flux mentioned hereinafter is measured in the same manner).

Table 1 shows the result of the measurement. The graph I shown in FIG. 14 indicates the trend of the change in the magnetic flux.

TABLE 1

| Surface Leakage Flux (1) | |
|---|---|
| Ferromagnetic member 5 | Leakage flux |
| None | 340 gauss |
| 0.03 mm thick | 283 gauss |
| 0.05 mm thick | 272 gauss |
| 0.08 mm thick | 262 gauss |
| 0.10 mm thick | 243 gauss |
| 0.15 mm thick | 215 gauss |
| 0.20 mm thick | 172 gauss |
| 0.30 mm thick | 143 gauss |

The abscissa in the graphs shown in FIGS. 14 through 16 respectively represents the thickness of the attraction means without the ferromagnetic member 5 (0.00 mm) and the thickness of the attraction means with the ferromagnetic members (0.03–0.30 mm), and the ordinate represents the surface leakage flux (in the unit of gauss) and the attraction force (in the unit of kg).

Surface leakage flux in the attraction means of the Embodiments as shown in FIG. 8, and of the Comparative Embodiments was measured according to the same method as mentioned above.

The result of measurement is shown in Table 2. The trend of the changes in the magnetic flux is shown in the graph II of FIG. 15.

TABLE 2

| Surface Leakage Flux (2) | |
|---|---|
| Ferromagnetic member 5 | Leakage flux |
| None | 361 gauss |
| 0.03 mm thick | 288 gauss |
| 0.05 mm thick | 273 gauss |
| 0.08 mm thick | 267 gauss |
| 0.10 mm thick | 248 gauss |
| 0.15 mm thick | 222 gauss |
| 0.20 mm thick | 181 gauss |
| 0.30 mm thick | 151 gauss |

Further, surface leakage flux in the attraction means of the Embodiments as shown in FIG. 9, and of the Comparative Embodiments was measured according to the same method as mentioned above.

The result of measurement is shown in Table 3. The trend of the changes in the magnetic flux is shown in the graph III of FIG. 15.

TABLE 3

| Surface Leakage Flux (3) | |
|---|---|
| Ferromagnetic member 5 | Leakage flux |
| None | 310 gauss |
| 0.03 mm thick | 221 gauss |
| 0.05 mm thick | 210 gauss |
| 0.08 mm thick | 190 gauss |
| 0.10 mm thick | 177 gauss |
| 0.15 mm thick | 137 gauss |
| 0.20 mm thick | 96 gauss |
| 0.30 mm thick | 76 gauss |

Attraction force of the fastener means according to the Embodiments and Comparative Embodiments was then measured. The Comparative Embodiments and the Embodiments as shown in FIG. 11 were subjected to measurement using the device for measuring the pulling force as shown in FIG. 17. The result is shown in Table 4. Simple averages of the measured attraction force were 3.85 kg in the fastener means without the ferromagnetic member 5, 3.80 kg in the fastener means with 0.03 mm thick ferromagnetic member 5, 3.80 kg in the fastener means with 0.05 mm thick member, 3.49 kg in the means with 0.08 mm thick member, 3.25 kg in the means with 0.10 mm thick member, 3.07 kg in the means with 0.15 mm thick member, 2.89 kg in the means with 0.20 mm thick member, and 2.24 kg in the means with 0.30 mm thick member. These averages are plotted in the graph IV in FIG. 14.

TABLE 4

| Attraction Force Measurement (1) (kg) | | | | | |
|---|---|---|---|---|---|
| Ferromagnetic member 5 (thickness) | I | II | III | IV | V |
| None | 3.90 | 3.80 | 3.90 | 3.80 | 3.85 |
| 0.03 mm | 3.75 | 3.85 | 3.75 | 3.75 | 3.90 |
| 0.05 mm | 3.80 | 3.80 | 3.75 | 3.90 | 3.75 |
| 0.08 mm | 3.45 | 3.65 | 3.35 | 3.35 | 3.65 |
| 0.10 mm | 3.35 | 3.20 | 3.30 | 3.15 | 3.25 |
| 0.15 mm | 3.00 | 3.05 | 3.00 | 3.25 | 3.05 |
| 0.20 mm | 2.85 | 3.05 | 2.90 | 2.85 | 2.80 |
| 0.30 mm | 2.20 | 2.20 | 2.25 | 2.35 | 2.20 |

Attraction force of the Embodiment fastener means as shown in FIG. 12 and Comparative Embodiments was measured in the same manner as mentioned above. The result is shown in Table 5. Simple averages of the measured attraction force were 3.75 kg in the fastener means without the ferromagnetic member 5, 3.66 kg in the fastener means with 0.03 mm thick ferromagnetic member 5, 3.65 kg in the fastener means with 0.05 mm thick member, 3.40 kg in the means with 0.08 mm thick member, 3.19 kg in the means with 0.10 mm thick member, 2.98 kg in the means with 0.15 mm thick member, 2.78 kg in the means with 0.20 mm thick member, and 2.14 kg in the means with 0.30 mm thick member. These averages are plotted in the graph V in FIG. 15.

TABLE 5

| Attraction Force Measurement (2) (kg) | | | | | |
|---|---|---|---|---|---|
| Ferromagnetic member 5 (thickness) | I | II | III | IV | V |
| None | 3.75 | 3.70 | 3.80 | 3.70 | 3.80 |
| 0.03 mm | 3.70 | 3.65 | 3.60 | 3.70 | 3.65 |
| 0.05 mm | 3.65 | 3.60 | 3.70 | 3.70 | 3.60 |
| 0.08 mm | 3.40 | 3.35 | 3.50 | 3.35 | 3.40 |
| 0.10 mm | 3.10 | 3.20 | 3.20 | 3.30 | 3.15 |
| 0.15 mm | 3.00 | 2.95 | 2.90 | 3.05 | 3.00 |
| 0.20 mm | 2.80 | 2.75 | 2.80 | 2.85 | 2.70 |
| 0.30 mm | 2.15 | 2.10 | 2.10 | 2.20 | 2.15 |

Attraction force of the Embodiment fastener means as shown in FIG. 13 the Comparative Embodiments was measured in the same manner as mentioned above. The result of measurement is shown in Table 6. Simple averages of the measured attraction force were 3.76 kg in the fastener means without the ferromagnetic member 5, 3.68 kg in the fastener means with 0.03 mm thick ferromagnetic member 5, 3.65 kg in the fastener means with 0.05 mm thick member, 3.43 kg in the means with 0.08 mm thick member, 3.12 kg in the means with 0.10 mm thick member, 2.99 kg in the means with 0.15 mm thick member, 2.69 kg in the means with 0.20 mm thick member, and 2.08 kg in the means with 0.30 mm thick member. These averages are plotted in the graph VI in FIG. 16.

TABLE 6

| Ferromagnetic member 5 (thickness) | Attraction Force Measurement (3) (kg) I | II | III | IV | V |
|---|---|---|---|---|---|
| None | 3.70 | 3.75 | 3.75 | 3.80 | 3.80 |
| 0.03 mm | 3.65 | 3.70 | 3.60 | 3.70 | 3.75 |
| 0.05 mm | 3.60 | 3.60 | 3.65 | 3.70 | 3.70 |
| 0.08 mm | 3.50 | 3.35 | 3.35 | 3.50 | 3.45 |
| 0.10 mm | 3.00 | 3.10 | 3.15 | 3.15 | 3.20 |
| 0.15 mm | 2.90 | 2.95 | 3.00 | 3.00 | 3.10 |
| 0.20 mm | 2.75 | 2.70 | 2.65 | 2.70 | 2.65 |
| 0.30 mm | 2.10 | 2.00 | 2.00 | 2.15 | 2.15 |

These measurements on leakage flux and attraction force indicate that the attraction means of the fastener means becomes more effective when it is covered with a ferromagnetic member 5; more particularly, the permanent magnet constituting the attraction means is preferably covered with a ferromagnetic member 5 of the thickness in the range of from 0.03 to 0.20 mm.

In other words, the Comparative Embodiments comprising the attraction means that is not covered with the ferromagnetic member 5 on the surface of the permanent magnet exhibited leakage flux which was more than 300 gauss. Magnetically recorded information on magnetic tapes and tickets are likely to be destroyed when the tapes or the tickets come in close contact with the attraction means. However, by covering the surface of the permanent magnet with a ferromagnetic member 5 having the thickness of more than 0.03 mm, surface leakage flux from the attraction means can be reduced to 300 gauss or less without a significant loss of attraction force.

Surface leakage flux from the attraction means can be suppressed by providing the surface of the permanent magnet with a plating of ferromagnetic material 5. No inconveniences will arise even if the ferromagnetic member 5 is coated with a non-magnetic plating, so long as the ferromagnetic member 5 has the thickness of from 0.03 to 0.20 mm.

When the ferromagnetic member 5 is thinner than 0.03 mm, surface leakage flux from the attraction means shows an abrupt increase, and the ferromagnetic member 5 itself becomes too brittle to give sufficient protection for the outer surface of the attraction means. On the other hand, if the thickness of the ferromagnetic member 5 exceeds 0.20 mm and reaches 0.3 mm, attraction force of the fastener means decreases significantly, making it unsuitable for use.

FIG. 18 shows a typical embodiment of the present invention, more specifically the fastener means shown in FIG. 11 in an exploded view. The fastener means comprises a ferromagnetic member 5 which is shaped like an upside-down dish and is provided with a hole 5*a*, a bent collar 5*a'* inside the hole 5*a*, and claws 5*b* provided at the open edge of the dish-like member 5. Thus the collar 5*a'* of the member 5 will abut against the peripheral edge of the through-hole 4 of the permanent magnet 1 and the claws 5*b* will be bent on the surface of the ferromagnetic member 2 when the member 5 and the magnet 1 are integrally held inside a casing to form the attraction means. The component parts identical with those in the embodiments described in the foregoing are given the same reference numbers and the description is omitted.

FIG. 19 shows a fastener means wherein the ferromagnetic member 5 is formed as a casing and has a peripheral side wall 5*c* which is erected along the peripheral edge of the ferromagnetic member 5 at its attraction face. This construction prevents lateral movement of the attracted means attracted to the attraction face of the attraction means, and is also advantageous in that said peripheral side wall 5*c* protects magnetic tapes or magnetically operable tickets from directly contacting the attraction means. The component parts identical with those in the embodiments described in the foregoing are given the same reference numbers and the description is omitted.

FIG. 20 shows a fastener means wherein the leg member 6 is omitted; instead, cylindrical caulking members 13 are attached to the ferromagnetic members 2 and 3 respectively by means of the projections 2*a* and 3*a*. Each caulking member 13 comprises a cylinder portion with a horizontal outer collar 13*a'* on one side, and a seat 13*b* which is attached to the outer collar 13*a'*.

The component parts identical with those in the embodiments described in the foregoing are given the same reference numbers and the description is omitted.

The fastener means shown in FIG. 21 uses a double coated tape 14 as the means to attach the fastener means; the double coated adhesive tape 14 are adhered to the ferromagnetic members 2 and 3 respectively to form the fastener means.

The component parts identical with those in the foregoing embodiments are given the same reference numbers and the description is omitted.

The fastener means shown in FIG. 22 is used as a clasping means for chains and strings such as necklaces; the ferromagnetic members 2 and 3 are respectively provided with fixing holes 2*d* and 3*d* for the chain 15 and the like.

The component parts identical with those in the foregoing embodiments are given the same reference numbers and the description is omitted.

The foregoing embodiments are the typical ones, and other constructions are possible for both the attraction and attracted means as well as for the fixing means to suit the requirements of each individual use of the fastener means.

As has been described in the foregoing, because the permanent magnet 1 which constitutes the fastener means according to the present invention has a ferromagnetic member 2 on one of the magnetic pole surfaces and is covered with a ferromagnetic member 5 on the other magnetic pole surface 1*b* as well as on the surface extending between the magnetic pole surfaces 1*a* and 1*b*, a magnetic path is formed between the magnetic pole surfaces 1*a* and 1*b* via the ferromagnetic member 5. When the thickness of the ferromagnetic member 5 is in the range of from 0.03 to 0.20 mm, the total magnetic flux passing through said ferromagnetic member 5 can be maintained within a given range.

In the fastener means according to the present invention, the attraction means is provided with a through-hole 4 extending between the two magnetic pole surfaces and a ferromagnetic member 2 is attached to one of the magnetic poles. By covering the surfaces of the permanent magnet where this ferromagnetic member 2 is not attached (including or excluding the through-hole 4) with the ferromagnetic member 5 in the form of casing or plating, surface leakage flux from the attraction means can be reduced significantly. To reduce the leakage flux to 300 gauss or less while maintaining the attraction force of the fastener means not less than 2.50 kg, the thickness of the ferromagnetic member 5 is set within the range of from 0.03 to 0.20 mm. The present invention therefore provides a fastener means which has sufficient attraction force but low leakage flux from the attraction face.

What we claim is:

1. A fastener means comprising:

a permanent magnet having two opposing magnetic pole sides and a through-hole extending through said magnetic pole sides;

a first ferromagnetic member secured to and contacting one of the magnetic pole sides;

a second ferromagnetic member removably positioned against the other of the magnetic pole sides;

ferromagnetic material covering at least a portion of outer surfaces of said permanent magnet that is not in contact with said first ferromagnetic member to minimize the flux leakage without substantially decreasing usable attraction force between said permanent magnet and said second ferromagnetic member; and ferromagnetic means provided one of both of said first and second ferromagnetic members which extend into said through-hole for magnetically attracting said first and second ferromagnetic members via said through-hole.

2. The fastener means according to claim 1, wherein said ferromagnetic material covers said outer surfaces of said permanent magnet, but excluding the peripheral surface of said through-hole.

3. The fastener means according to claim 1, wherein said ferromagnetic material covers said outer surfaces of said permanent magnet and covers a portion of the peripheral surface of said through-hole.

4. The fastener means according to claim 1, 2 or 3, wherein said ferromagnetic material covering said outer surfaces of said permanent magnet is a ferromagnetic casing.

5. The fastener means according to claim 1, 2 or 3, wherein said ferromagnetic material covering said outer surfaces of said permanent magnet is a ferromagnetic plating.

6. The fastener means according to claim 4, wherein said ferromagnetic material has a thickness of about 0.03 mm to 0.20 mm.

7. The fastener means according to claim 5, wherein said ferromagnetic material has a thickness of about 0.03 mm to 0.20 mm.

8. The fastener means according to claim 2 or 3, wherein said first ferromagnetic member comprises a first ferromagnetic plate having a pair of opposed sides, said ferromagnetic means comprising a first ferromagnetic pole extending perpendicularly from one of said pair of opposed sides, said one side being in contact with said one magnetic pole side with said first pole extending into said through-hole.

9. The fastener means according to claim 8, wherein said second ferromagnetic member comprises a second ferromagnetic plate having a pair of opposed sides, with one side thereof removably positionable to contact said ferromagnetic material covering said other magnetic pole side, wherein said first pole contacts said one side of said second ferromagnetic plate when said second ferromagnetic plate is positioned against said other magnetic pole side.

10. The fastener means according to claim 8, wherein said second ferromagnetic member comprises a second ferromagnetic plate having a pair of opposed sides, said ferromagnetic means further comprising a second ferromagnetic pole extending perpendicularly from one side of said pair of opposed sides, said one side of said second ferromagnetic plate being removably positionable to contact said ferromagnetic material covering said other magnetic pole side, wherein said second pole extends into said through-hole and contacts said first pole when said second ferromagnetic plate is positioned against said other magnetic pole side.

11. The fastener means according to claim 2 or 3, wherein said second ferromagnetic member comprises a ferromagnetic plate having a pair of opposed sides, said ferromagnetic means comprising a ferromagnetic pole extending from one of said pair of opposed sides, said one side of said ferromagnetic plate being removably positionable to contact said ferromagnetic material covering said other magnetic pole side, wherein said pole extends into said through-hole when said ferromagnetic plate is positioned against said other magnetic pole side.

12. The fastener means according to claim 11, wherein said first ferromagnetic member comprises a ferromagnetic plate having a pair of opposed sides, with one side thereof in contact with said one magnetic pole side, wherein said pole extends into said through-hole and contacts said one side of said ferromagnetic plate of said first ferromagnetic member when said ferromagnetic plate of said second ferromagnetic member is positioned against said other magnetic pole side.

* * * * *